United States Patent [19]

Okada et al.

[11] Patent Number: 4,555,466

[45] Date of Patent: Nov. 26, 1985

[54] DEVELOPER COMPRISING A CARRIER COATED WITH $FE_3O_4$ DISPERSED IN A BUTADIENE POLYMER, AND A TONER

[75] Inventors: Seiji Okada, Sagamihara; Isao Watanabe, Kawasaki; Norio Sawatari, Sagamihara; Kazumasa Saito, Atsugi; Toshiaki Narusawa; Hirofumi Okuyama, both of Sagamihara, all of Japan

[73] Assignee: Fujitsu Limited, Kawasaki, Japan

[21] Appl. No.: 534,462

[22] Filed: Sep. 21, 1983

[30] Foreign Application Priority Data

Sep. 27, 1982 [JP] Japan ..... 57-166714
Jan. 14, 1983 [JP] Japan ..... 58-3290

[51] Int. Cl.[4] ..... G03G 9/10; G03G 11/00

[52] U.S. Cl. ..... 430/106.6; 430/108; 430/109; 430/137

[58] Field of Search ..... 430/106.6, 108, 109, 430/137

[56] References Cited

U.S. PATENT DOCUMENTS 3,926,628 12/1975 Honjo ..... 430/107
4,374,192 2/1983 Mayer et al. ..... 430/108
4,414,322 11/1983 Miyakawa et al. ..... 430/106.6

*Primary Examiner*—John L. Goodrow
*Attorney, Agent, or Firm*—Armstrong, Nikaido, Marmelstein & Kubovcik

[57] ABSTRACT

A developing material for electrostatic images comprising (a) carrier particles comprising iron beads coated with a layer of butadiene polymer resin in which $Fe_3O_4$ powder is dispersed, the volume ratio of the polymer resin to $Fe_3O_4$ is from 1:2 to 4:1, and the butadiene polymer is cured by heating with an organic peroxide of from 0.5 to 5.0 parts by weight, based on the weight of the butadiene polymer, which comprises a homopolymer containing 1,2-polybutadiene units, or a homopolymer or copolymer of cyclized 1,4-cis-polybutadiene and (b) from 1% to 6% by weight, based on the weight of the carrier particles, of toner particles which comprise a bis-phenol A-epichlorohydrin type resin, carbon powder, a nigrosine dye, and either a styrene-n-butyl acrylate copolymer or a montan wax.

11 Claims, 8 Drawing Figures

DEVELOPER COMPRISING A CARRIER COATED WITH $FE_3O_4$ DISPERSED IN A BUTADIENE POLYMER, AND A TONER

BACKGROUND OF THE INVENTION

1. Field of the Invention

The present invention relates to a developing material for electrostatic images, more particularly to a developing material for electrostatic images for use in a laser printer.

2. Description of the Prior Art

A known developing material for electrostatic images comprises a mixture of smaller resinous toner particles and larger carrier particles made of iron beads. The toner particles are held on the surface of the carrier particles by electrostatic force, which develops from the triboelectric charging of the toner particles and the carrier particles in opposite polarities due to contact therebetween. When the developing material is moved into contact with the latent electrostatic images formed on a photoreceptor, the toner particles are attracted to the latent images, and, thus, the images are developed. The developed images are transferred onto plain paper and fixed thereon by heating.

Electrostatic developing materials are used in copying printers, printers for computer systems, and the like. They allow dry, high speed, high resolution image printing on diverse kinds of paper.

The demand for electrostatic developing material has particularly grown in the field of laser printers for computer systems. Recent printers for computer systems must be able to output at a high resolution not only the relatively simple alphanumeric type but also very complicated Chinese characters. Laser printers are advantageous in that a laser beam usually has a spot diameter of from 100 to 150 $\mu$m.

Generally, the bulk electric resistivity (below, "electric resistivity") of the carrier particles is in linear proportion with the toner parameter, "toner parameter" being defined as the amount of positive charge ($\mu$C) on the toner particles per unit weight (g) of toner particles.

A desirable toner parameter is considered to be from 10 to 30 $\mu$C/g, depending on the type of the development system, which corresponds to an electric resistivity of the carrier particles of from $10^5$ to $10^7$ $\Omega$·cm.

If the electric resistivity of the carrier particles is too high, the negative charge on the carrier particles increases until almost the saturation point (below, "charge-up of carrier particles"), making it difficult to generate a further negative charge on the carrier particles and, consequently, to impart a counter positive charge on the toner particles, as required for effective functioning of the developing material.

In addition, a high electric resistivity of the carrier particles leads to an increased potential drop through the so-called "magnetic brush" on the magnetic drum of the developer, preventing sufficient toner particles from depositing on the latent images.

To avoid these problems, the electric resistivity of the carrier particles must be kept low. A conceivable method of doing this would be to coat the carrier particles with a resin containing carbon powder. It is difficult, however, to keep the carbon powder uniformly dispersed in the carrier coating resin, because the powder tends to separate from the coating resin while the coated carrier particles are being mixed in the developer.

Another problem is "toner filming". Toner filming occurs due to a number of collisions between the toner particles and carrier particles. The attendant mechanical friction causes the toner material to partially melt and fuse on not only the surface of the carrier particles, but also the surface of the photoconductive drum, i.e., photoreceptor. Such fused toner is called "spent toner". Toner filming makes the surface of the carrier particles substantially the same as the toner particles and thereby deteriorates in the triboelectric property. It also makes the surface of the photoconductive drum less optically sensitive and, so, produces afterimages.

To prevent toner filming on carrier particles, it is known to provide the carrier beads coated with a fluorocarbon layer. Such a fluorocarbon layer, however, exhibits too high an electric resistivity and poor mechanical strength.

Proposals have also been made to solve this problem by using a filming-resistant material as the binder resin of the toner particles, but these materials usually have had high melting points, which have resulted in incomplete thermal fixation.

SUMMARY OF THE INVENTION

It is an object of the present invention to provide a developing material for electrostatic images with an excellent printing quality.

It is another object of the present invention to provide a developing material which can print images with a high resolution.

It is still another object of the present invention to provide a developing material with a reduced electric resistivity.

It is still another object of the present invention to provide a developing material with less toner filming.

According to the present invention, there is provided with a developing material for electrostatic images comprising: (a) carrier particles comprising iron beads coated with a layer comprising a butadiene polymer resin in which $Fe_3O_4$ powder is dispersed, the volume ratio of the butadiene polymer resin to $Fe_3O_4$ powder being from 1:2 to 4:1 and the butadiene polymer being cured by heating with an organic peroxide in an amount of from 0.5 to 5.0 parts by weight based on 100 parts by weight of the butadiene polymer resin, and (b) from 1% to 6% by weight, based on the weight of the carrier particles, of toner particles.

BRIEF DESCRIPTION OF THE DRAWINGS

Other objects and advantages of the invention will be apparent from the following description referring to drawings, in which.

DESCRIPTION OF THE PREFERRED EMBODIMENTS

Before describing the preferred embodiments of the invention, an explanation of the mechanism of electrostatic development in a laser printer will be provided as reference.

Figure 1:
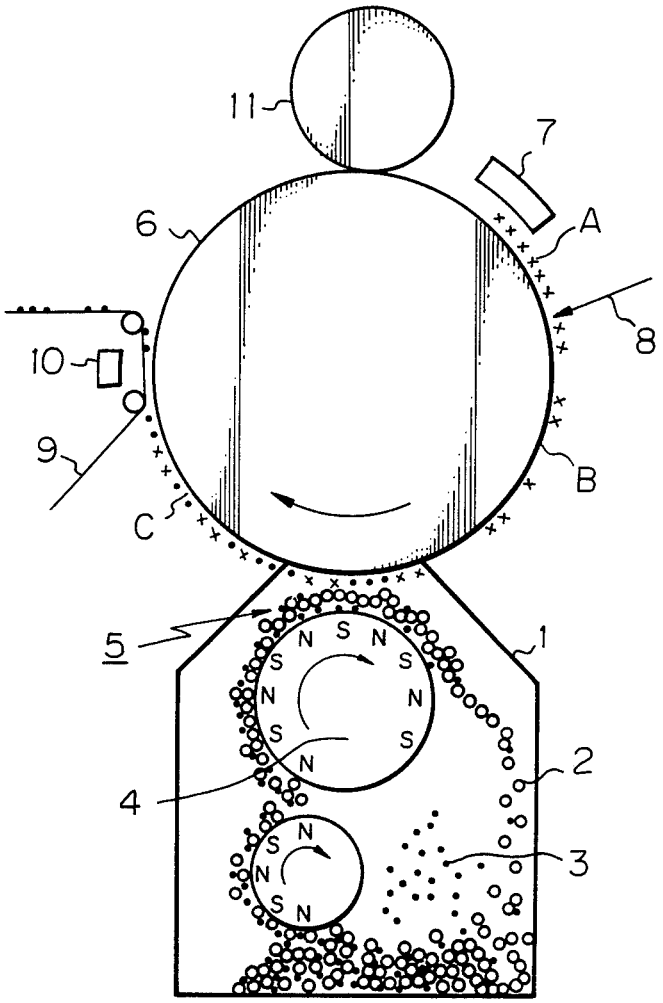
FIG. 1 is a schematic sectional view of a laser printer.

As shown in FIG. 1, a developer 1 contains a developing material which is a mixture of carrier particles 2 and toner particles 3. The carrier particles 2 are ferromagnetic and are thus attracted on rotating magnetic drums 4. They are mixed with the toner particles 3 during rotation. The carrier and toner particles are triboelectrically charged, the former to negative and the latter to positive. Thus, the toner particles 3 are electrostatically attracted on the surface of the carrier particles 2, to form the so-called magnetic brush 5 on the magnetic drum 4.

A photoconductive drum 6 is located over the opening of the developer 1, through which opening the magnetic brush 5 contacts the periphery of the drum 6. A charger 7 establishes a uniformly positive charged area A on the drum 6. As the drum 6 rotates, a laser beam 8 is directed to the charged area A to make the irradiated spots of the drum 6 electrically conductive. Thus, the spotted areas become free from positive electrical charges and form latent images B.

Figure 2:
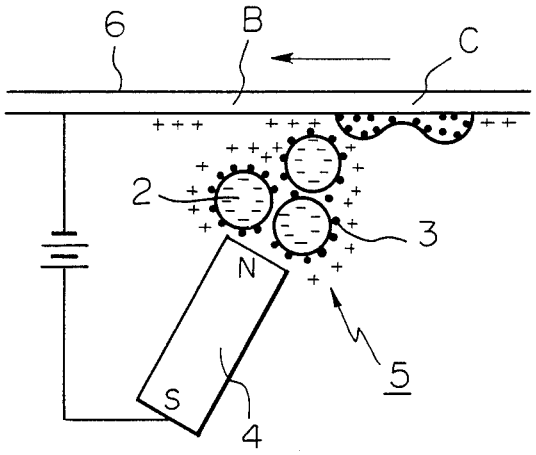
FIG. 2 is an illustrative model of a magnetic brush applied on the surface of a photoreceptor.
Figure 3:
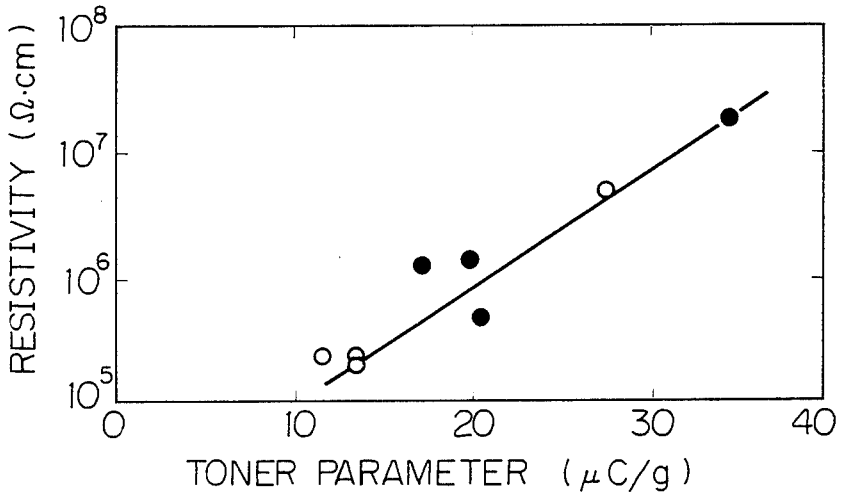
FIG. 3 is a graph of the relationship between the electric resistivity of carrier particles and the toner parameter.

As the photoconductive drum 6 continues rotation so as to contact the magnetic brush 5, positively charged toner particles 3 separate from the carrier particles 2 and deposit electrostatically on the latent images B on the drum 6, changing the latent images B to developed images C. This is usually promoted by applying a bias potential between the brush 5 and the drum 6, as shown in FIG. 2. The carrier particles 2 are still magnetically held on the magnetic drum 4 and are scraped therefrom and mixed with newly introduced toner particles 3. The developed images C are transferred onto a sheet of paper 9 by means of a thermal fixer 10. The toner particles 3 remaining on the drum 6 are cleaned off with a cleaning brush 11.

The mixing ratio of toner particles to carrier particles, according to the present invention, is from 1% to 6% by weight.

If the mixing ratio is less than 1%, based on the weight of the carrier particles, the printed images do not exhibit satisfactory optical density. If it is more than 6%, excess toner particles which do not directly contact the surface of the carrier particles occur. These then fly away and deposit on areas not to be developed, such as the background of paper, and the surface of the photoconductive drum.

The carrier particles comprise iron beads coated with a layer comprising butadiene polymer resin in which $Fe_3O_4$ powder is dispersed.

The average diameter of the iron beads is preferably from 30 to 500 μm, most preferably from 50 to 250 μm. If the diameter is less than 30 μm, the iron beads tend to deposit on the latent image area reversely accompanied by toner particles and thus reduce the printing quality. If the diameter is larger than 500 μm, delicate fine patterns such as Chinese characters cannot be printed with sufficient resolution.

Figure 5:
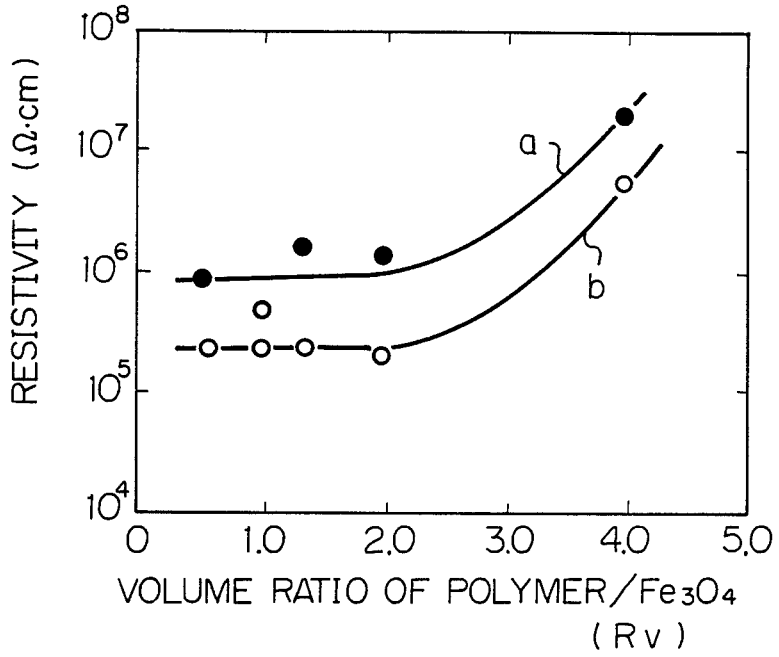
FIG. 5 is a graph of the relationship between the electric resistivity of carrier particles and the volume ratio of the butadiene polymer resin to $Fe_3O_4$ powder dispersed therein.

As mentioned earlier, the electric resistivity of the carrier particles should be from $10^5$ to $10^7$ Ω·cm to enable the desirable toner parameter of 10 to 30 μC/g, as shown in FIG. 5. To obtain a electric resistivity of the carrier particles below $10^7$ Ω·cm, the iron beads must not have too high an electric resistivity.

Figure 4:
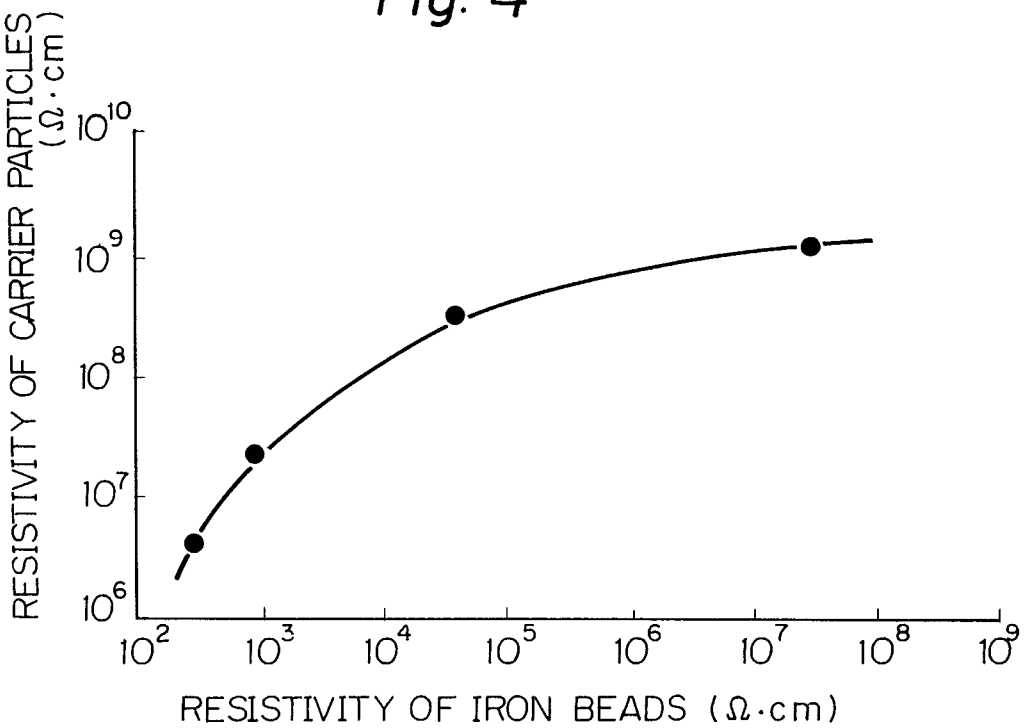
FIG. 4 is a graph of the relationship between the electric resistivity of carrier particles and that of the iron beads.

Here, the bulk electric resistivity is determined by an original method, wherein we introduce the beads or carrier particles into an enclosed box, on the opposing sides of which thin metal plates are provided, apply a magnetic field through the metal plates and beads or particles, so as to form a magnetic brush between the metal plates, then apply a D.C. potential therebetween. As shown in FIG. 4, to obtain a bulk electric resistivity of the carrier particles of less than $10^7$ Ω·cm, the particles being those prepared by the process of Example 1 below (except for electric resistivity of iron beads), the iron beads must have an electric resistivity of no more than $10^3$ Ω·cm.

The butadiene polymer consists of hydrogen and carbon atoms, and has a relatively low dielectric constant. This leads to an improvement in triboelectric property between the carrier and toner particles. The butadiene polymer preferably comprises either a butadiene homopolymer, the number average molecular weight of which is from 10,000 to 200,000 and, which contains at least 50% by weight of 1,2-polybutadiene units, or a cyclized 1,4-cis-polybutadiene homopolymer or a cyclized 1,4-cis-butadiene-styrene or cyclized 1,4-cis-butadiene-acrylonitryl copolymer, which copolymer contains at least 50% by weight of 1,4-cis-polybutadiene units or a mixture thereof.

If the butadiene polymer contains less than 50% by weight of 1,2-polybutadiene units, the polymer loses its inherent filming-resistant property. If its number average molecular weight is less than 10,000, the uncured polymer is a semisolid or even a liquid, and, therefore, the iron beads tend to aggregate. If the molecular weight is more than 200,000, the polymer loses its desired solubility and cannot coat the iron beads. If the cyclized butadiene-styrene or butadiene-acrylonitrile copolymer contains less than 50% by weight of cis-1,4-polybutadiene units, the polymer loses its inherent filming-resistant property.

The butadiene polymer resin is cured by heating with an organic peroxide in an amount of from 0.5 to 5.0 parts by weight based on 100 parts by weight of the resin. An adequate degree of cure improves the triboelectric property and the mechanical strength of the coating layer. If the amount of organic peroxide is less than 0.5 part by weight, the degree of cure is not high enough to obtain an appropriate triboelectric property. If it is more than 5.0 parts, the resin tends to have cracks, and the triboelectric property is excessively large. Consequently, in order to maintain an adequate triboelectric property, it is necessary to mix excess toner particles, which, however, leads to an undesirable printing quality.

$Fe_3O_4$ powder exhibits an electric resistivity of from $10^3$ to $10^6$ Ω·cm, approximately that of a semiconductor, and, therefore, is a suitable material to lower the electric resistivity of the carrier particles. The average particle diameter of the $Fe_3O_4$ powder is preferably from 0.1 to 1.0 μm, most preferably from 0.1 to 0.5 μm. If the diameter is less than 0.1 μm, it is difficult to uniformly disperse the powder in the coating layer. If it is more than 1.0 μm, the $Fe_3O_4$ powder tends to extrude from the coating layer and to drop off during long term operation.

The volume ratio of the butadiene polymer resin to $Fe_3O_4$ powder is from 1:2 to 4:1, preferably from 1:1 to 2:1. If the ratio is less than 1:2, the $Fe_3O_4$ powder tends to drop off from the coating layer during long term operation. If it is more than 4:1, the electric resistivity of the carrier particles increases to more than the desired range.

We prepared carrier particles coated with a butadiene polymer resin in which $Fe_3O_4$ powder is dispersed by the process described later in Example 1, except that we changed the volume ratio of the polymer resin to $Fe_3O_4$ (Rv) in the range of from 1:2 to 4:1.

Figure 6:
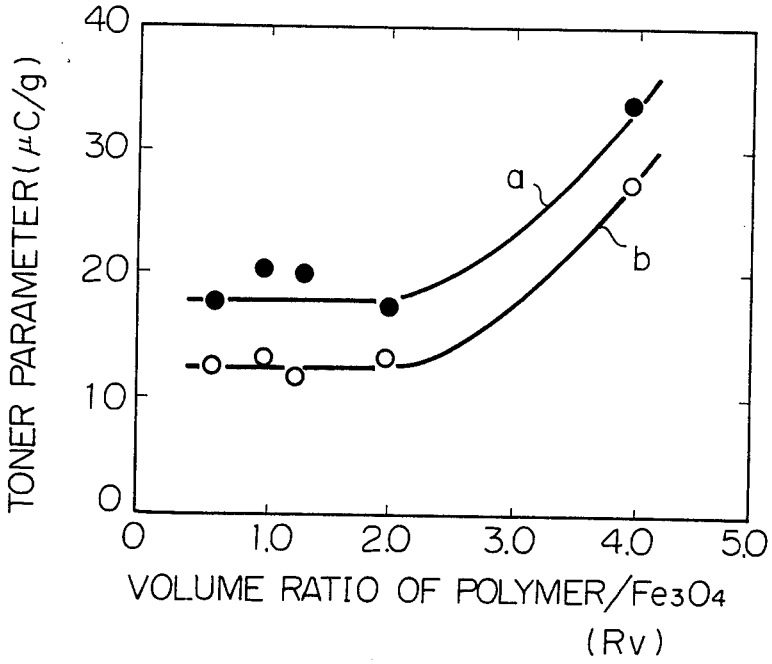
FIG. 6 is a graph of the relationship between the toner parameter and the volume ratio of butadiene polymer resin to $Fe_3O_4$ powder dispersed therein.

FIG. 5 is a graph of the relationship between the electric resistivity of carrier particles and the volume ratio of the butadiene polymer resin to $Fe_3O_4$ powder. FIG. 6 is a graph of the relationship between the toner parameter and the volume ratio of butadiene polymer resin to $Fe_3O_4$ powder dispersed therein. Curves (a) and (b) correspond to coated carrier particles, with average diameters of 80 μm and 140 μm, respectively. As may be seen, we obtained the preferable amount of electric resistivity and toner parameter of from $10^5$ to $10^7$ Ω·cm and from 10 to 30 μC/g, respectively, and the most preferable amount of from $10^5$ to $10^6$ Ω·cm and from 10 to 20 μC/g, respectively.

The thickness of the carrier coating layer is preferably from 0.1 to 10 μm, most preferably from 0.1 to 1.5 μm. If the thickness is less than 0.1 μm, it is difficult to uniformly disperse the $Fe_3O_4$ particles or to maintain its filming-resistant property. If it is greater than 10 μm, the electric resistivity of the layer increases to an unallowable extent.

The toner particles preferably comprises a bis-phenol A-epichlorohydrin type resin as a base component of the binder resin. The bis-phenol A-epichlorohydrin type resin preferably has a melting point of from 60° C. to 160° C., weight average molecular weight of from 3,000 to 30,000, and an epoxy equivalent of from 450 to 5,500 and contains up to 4% by weight of monomeric bis-phenol A-glycidyl ether. If the melting point is lower than 60° C., the toner particles tend to adhere to each other, i.e., to cause blocking. If the melting point is higher than 160° C., undesirable fixation on the paper occurs. If the weight average molecular weight is less than 3,000 or more than 30,000 or if the epoxy equivalent is less than 450 or more than 5,500, the melting point is outside the desired range.

The binder resin of the toner particles preferably comprise from 10% to 30% by weight, based on the weight of the toner particles, of a styrene-n-butyl acrylate copolymer resin. The styrene-n-butyl acrylate copolymer resin preferably has a softening point of from 100° C. to 150° C. and a weight average molecular weight of from 10,000 to 100,000 and contains up to 0.5% by weight of volatile matter. The styrene-n-butyl acrylate copolymer increases the melting viscosity of the binder resin so as to avoid coagulation of molten toner particles and, consequently, to avoid small cavities in the fixed toner image area and to improve the filming-resistant property of the toner particles. This copolymer also promotes easy fixing of the toner particles by heat oven fixation and hot roll fixation.

If the content of the styrene-n-butyl acrylate copolymer is less than 10% by weight, the toner particles do not exhibit these advantages. More than 30% by weight of this copolymer deteriorates the thermal fixation. If its softening point or weight average molecular weight are lower than 100° C. or 10,000, respectively, the toner particles tend to produce small cavities in the developed images. If they are higher than 150° C. or 100,000, respectively the toner particles also deteriorate in the thermal fixation. If the styrene-n-butyl acrylate copolymer contains more than 0.5% by weight of volatile matter, unfavorable odors occur at the thermal fixation.

As a filming-resistant agent, the toner particles preferably contain from 0.5 to 1.0% by weight of a montan wax. If the content of a montan wax is higher than 1%, the wax tends to diffuse from the toner on the surfaces of carrier particles and photoconductive drum. Less than 0.5% by weight of a montan wax does not exhibit an enough effect to avoid toner filming. If this wax is not contained in the toner particles, styrene-n-butyl acrylate copolymer must be contained therein.

The toner particles preferably contain from 0.6% to 8% by weight of carbon powder. If the content is less than 0.6% by weight, it is difficult to obtain a satisfactory optical density. More than 8% by weight of carbon raises the softening point and melting point of the toner particles and, consequently, deteriorate the thermal fixation. The toner particles may not contain a dye. More than 5% by weight of a dye lowers triboelectric property of toner particles.

The average diameter of the toner particles is preferably from 5 to 30 μm, most preferably from 5 to 25 μm. If the toner comprises particles of smaller than 5 μm, such fine particles preferentially occupy the surfaces of the carrier particles due to their relatively large specific electric charge per unit weight and prevent further deposition of toner particles. Toner particles of more than 30 μm diameter do not have enough electric charge to obtain a satisfactory printing quality.

EXAMPLE 1

First, 100 g of $Fe_3O_4$ powder (Toda Kogyo K.K., EPT-500), 25 g of 1,2-polybutadiene (Nippon Gosei Gum K.K., RB-810), 0.25 g of dicumyl peroxide, and 1 l of trichloroethylene were mixed in a polyethylene pot with steel balls, which was rotated at 150 rpm for one hour. Five kg of spherical iron beads having recesses on the surfaces (Nippon Teppun K.K., TS-200R) were added into the pot, which was rotated at 100 rpm for five hours, and from which trichloroethylene vapor was evacuated. The iron beads were coated with a uniform layer and were transferred into a rotary furnace where the coating resin was cured at 180° C. for two hours. The coated iron beads were then filtered through a 100 mesh sieve to obtain carrier particles. The volume ratio of the polybutadiene to $Fe_3O_4$ was 1:1, the thickness of the coating layer 1.0 μm, the diameter of the $Fe_3O_4$ powder particles from 0.1 to 0.3 μm, and the average diameter of the iron beads 80 μm.

Next, 92.5 parts by weight of a bis-phenol A-epichlorohydrin type resin (Dainippon Ink Kogaku Kogyo K.K., Epiclon 4061) which contains 2.5% by weight of a monomeric bis-phenol A-glycidyl ether (epoxy equivalent 1,130, weight average molecular weight 6,800, melting point 110° C.), 3 parts by weight of carbon black (Cabot Co., Ltd., Black Pearls L), 5 parts by weight of a nigrosine base dye (Orient Kagaku K.K., Nigrosine Base EX), and 0.5 part by weight of a montan wax (Höchst A.G., Wax E) were blended in a kneader at 100° C. for 0.5 hour. The obtained blend was pulverized by means of a jet pulverizer and was classified by means of a blowing classifier to obtain toner particles of average diameter 10 μm.

A developing material was produced by mixing 3% by weight of toner particles with the carrier particles based on the weight of the carrier particles. The developing material was then used for printing under the conditions shown below:

| | |
|---|---|
| Development: | Reverse flash development with magnetic brush |
| Photoreceptor: | Se drum |
| Developing velocity: | 54 cm/s |
| Initial potential: | +700 V |
| Developing potential: | +500 V |
| Printing velocity: | 10,600 lines/min |

After printing 200,000 sheets of paper, the developed images retained the initial optical density and also high resolution of 12 lines/mm. In addition, the surface of the photoreceptor suffered substantially no toner filming and the spent toner on the surface of carrier particles was only 0.2% by weight of toner material, based on the weight of carrier particles. The toner parameter was kept stably near 15 μC/g.

EXAMPLE 2

Three kinds of developing materials A, B, and C were produced by the same process as Example 1, except that the toner particles were prepared by binding a bisphenol A-epichlorohydrin type epoxy resin (Dainippon Ink Kagaku Kogyo K.K., Epiclon 4061) which contained about 3% by weight of monomeric bis-phenol A-glycidyl ether (epoxy equivalent 1130, weight average molecular weight 6,800, melting point 110° C.), a styrene-n-butyl acrylate resin (Sanyo Kasei K.K., Hymer SBM-600, weight average molecular weight 60,000, softening point 140° C.), 5% by weight of carbon black (Cabot Co., Ltd., Black Pearls L), and 1% by weight of a nigrosine dye (Orient Kagaku K.K., Nigrosine Base EX) and were heated in a hot pressurized kneader for one hour. The resin components of the developing materials A, B, C were varied as shown in Table 1.

TABLE 1

| Resin Components of Toner | Resin Components A (%) | B (%) | C (%) |
|---|---|---|---|
| Epoxy resin | 84 | 74 | 64 |
| Styrene-acrylic resin | 10 | 20 | 30 |

Each obtained blend was pulverized by means of a jet pulverizer and was classified by means of a blowing classifier.

The developing material was produced by mixing 3% by weight of toner particles, based on the weight of the carrier particles. They were then used for printing under the same conditions as Example 1. Developing materials A, B, and C printed dense developed images having very few small cavities therein as revealed in a microscopic photograph. Almost no toner filming was detected on the carrier particles. In addition, the printing was easily controlled by applying bias potential between the photoconductive drum and the magnetic brush. However, the developing materials featured deteriorated thermal fixation on the paper.

EXAMPLE 3

A developing material was produced by the same process as Example 2-B, except that 2.5% by weight of the toner particles was mixed with the carrier particles. The printing condition was the same as Example 1.

Figure 7:
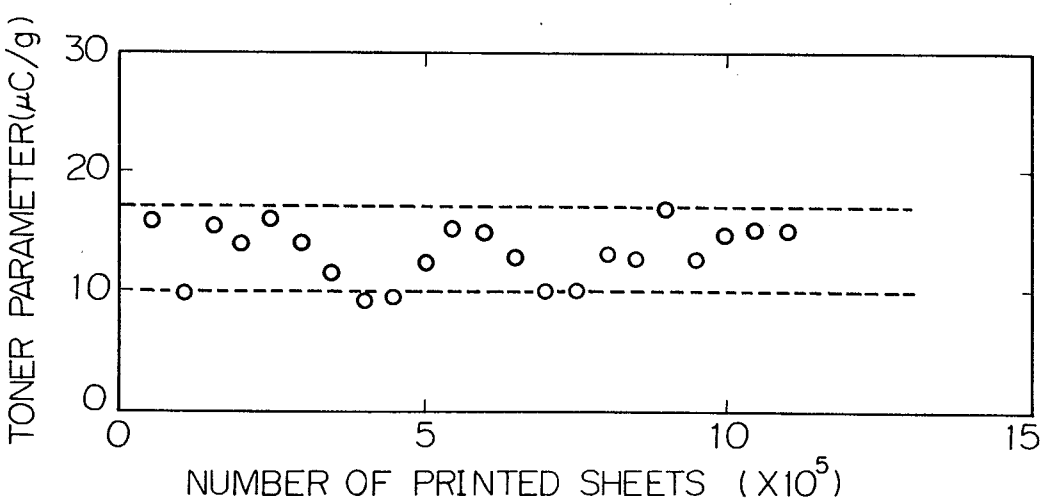
FIG. 7 is a graph of the relationship between the toner parameter and the number of printed sheets.
Figure 8:
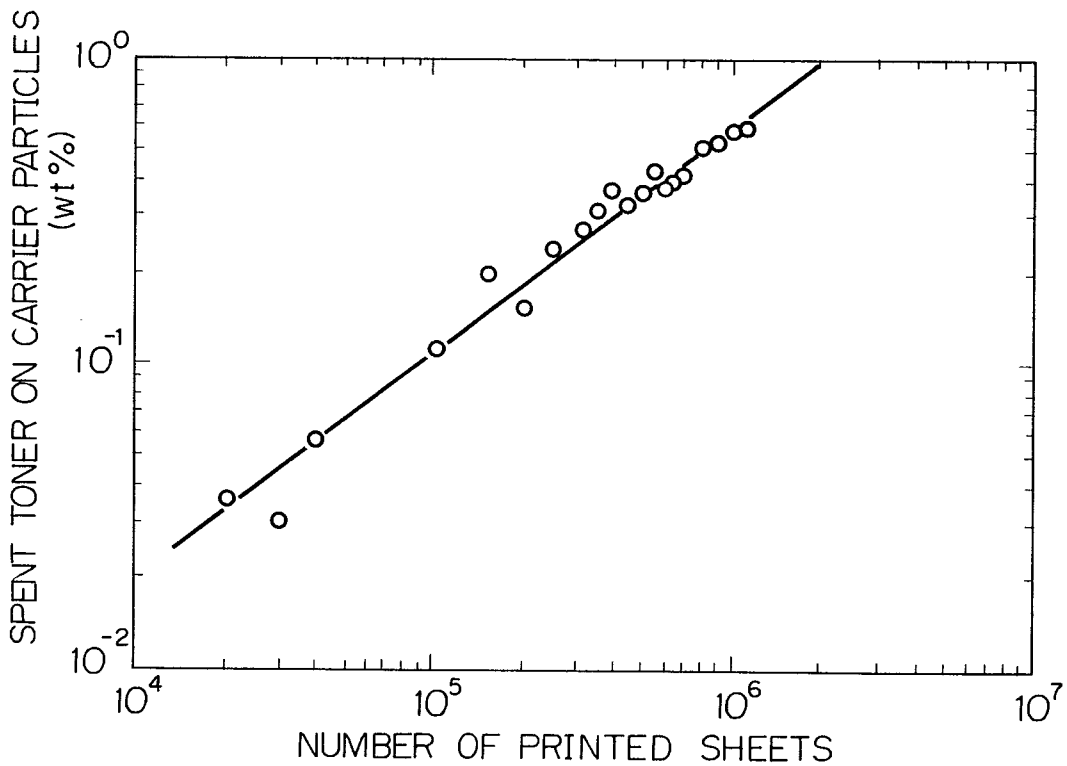
FIG. 8 is a graph of the relationship between the spent toner on carrier particles and the number of printed sheets.

The developed images exhibited a high resolution of 12 lines/mm, and satisfactory printing quality, optical density, face image property, and toner parameter. Such initial parameters were maintained even after $11\times10^5$ sheets printing (FIG. 7). After printing $2\times10^6$ sheets, no toner filming was detected on the surface of the photoreceptor drum. Although spent toner of less than 1.0% by weight was detected on the surfaces of the carrier particles (FIG. 8), the desirable initial printing performances were basically maintained, except for the face image property.

EXAMPLE 4

A developing material was produced by the same process as Example 2-B, except that cyclized 1,4-cis-polybutadiene (Nippon Gosei Gum K.K., CLBR) which had 60% of cyclized polybutadiene units was applied as the coating resin.

After printing under the conditions of Example 1, the performance was found to be approximately the same as in Example 2-B. However, amount of toner filming on the carrier particles was 0.65% by weight of the toner particles based on the weight of the carrier particles after printing $10^6$ sheets.

EXAMPLE 5

A developing material was produced by the same process as Example 2-B, except that the carrier particles were prepared by using 10 kg of spherical iron beads (Kanto Denka K.K., ST-200R, average diameter 140 μm). Approximately the same printing performance was obtained as in Example 2-B.

After printing $5\times10^5$ sheets, the amount of toner filming was as low as 0.3% by weight, but the electric resistivity of the carrier particles was $10^8$ Ω·cm, higher than the $10^6$ Ω·cm of TS-200R as used in Example 2, and the face image property and controllability of printing by applying bias potential were not as good in Example 2-B.

COMPARATIVE EXAMPLE 1

A developing material was produced by the same process as Example 2-B, except that the carrier particles were coated with a layer, which contained only 1,2-polybutadiene without dispersing $Fe_3O_4$ powder, and mixed with 4% by weight of toner particles. Under the same printing condition as Example 1, the toner parameter began to decrease after printing $2\times10^4$ sheets. After printing $2\times10^5$ sheets, toner particles flew off the surface of the carrier particles, to deteriorate the printing quality. In addition, these carrier particles exhibited an electric resistivity as high as more than $10^{11}$ Ω·cm. It was therefore impossible to control printing by applying bias potential.

COMPARATIVE EXAMPLE 2

A developing material was produced by the same process as Example 2-B, except that the amount of dicumyl peroxide was modified. When 0.4% by weight, the toner parameter began to decrease after printing $5\times10^5$ sheets. When 6% by weight, the toner parameter was too high to obtain a sufficient printing density with the weight ratio of toner particles of 6% by weight, based on the weight of carrier. In addition, the electric resistivity of the developing material increased so high that control of printing by applying bias potential was not effective.

COMPARATIVE EXAMPLE 3

A developing material was produced by the same process as Example 2, except that the toner material did not contain a styrene-n-butyl acrylate resin and that the weight ratio of toner particles to carrier particles was 4% by weight. After printing $4\times10^3$ sheets, toner filming was detected on the photoreceptor drum. After printing $10^4$ sheets, this filmed toner was offset on the paper.

We claim:

1. A developing material for electrostatic images comprising:

(a) carrier particles the electric resistivity of which is from $10^5$ to $10^7$ Ω·cm comprising iron beads having an average diameter of from 30 to 500 μm, coated with a layer comprising a butadiene polymer resin in which $Fe_3O_4$ powder is dispersed, said butadiene polymer resin comprises either a butadiene homopolymer the number average molecular weight of which is from 10,000 to 200,000 and which contains at least 50% by weight of 1,2-polybutadiene units, or a cyclized 1,4-cis-polybutadiene homopolymer, or a cyclized 1,4-cis-butadiene-styrene or cyclized 1,4-cis-butadiene-acrylonitrile copolymer which copolymer contains at least 50% by weight of 1,4-cis-polybutadiene units, or a mixture thereof, the volume ratio of said butadiene resin to $Fe_3O_4$ powder being from 1:2 to 4:1, and said butadiene polymer being cured by heating with an organic peroxide in an amount of from 0.5 to 5.0 parts by weight based on 100 parts by weight of said butadiene polymer, and (b) from 1% to 6% by weight of toner particles, based on the weight of said carrier particles.

2. A developing material according to claim 1, wherein the volume ratio of said butadiene polymer resin to $Fe_3O_4$ powder is 1:1 to 2:1.

3. A developing material according to claim 1, wherein said iron beads exhibit a bulk electrical resistivity of up to $10^3$ Ω·cm.

4. A developing material according to claim 1, wherein the thickness of said coating layer of said carrier particles is from 0.1 to 10 μm.

5. A developing material according to claim 4, wherein the thickness of said coating layers of said carrier particles is from 0.1 to 1.5 μm.

6. A developing material according to claim 1, wherein said $Fe_3O_4$ powder dispersed in said butadiene polymer resin has an average particle diameter of from 0.1 to 1.0 μm.

7. A developing material according to claim 6, wherein said $Fe_3O_4$ powder dispersed in said butadiene polymer resin has an average particle diameter of from 0.1 to 0.5 μm.

8. A developing material according to claim 1, wherein said iron beads have an average diameter of from 50 to 250 μm.

9. A developing material according to claim 1, wherein said toner particles comprise, as a base component, a bis-phenol A-epichlorohydrin type resin which has a melting point of from 60° C. to 160° C., a weight average molecular weight of from 3,000 to 30,000, and an epoxy equivalent of from 450 to 5,500 and which contains up to 4% by weight of monomeric bis-phenol A-glycidyl ether, and, each based on the weight of toner particles, from 0.6% to 8% by weight of carbon powder, from 0% to 5% by weight of a dye, and either from 0.5 to 1.0% by weight of a montan wax, or from 10% to 30% by weight of a styrene-n-butyl acrylate copolymer resin, which has softening point of from 100° C. to 150° C. and a weight average molecular weight of from 10,000 to 100,000 and which contains up to 0.5% by weight of volatile matter.

10. A developing material according to claim 1, wherein the average diameter of said toner particles is from 5 to 30 μm.

11. A developing material according to claim 10, wherein the average diameter of said toner particles is from 5 to 25 μm.

* * * * *